United States Patent [19]

Streit

[11] 4,256,007

[45] Mar. 17, 1981

[54] PERCUSSION INSTRUMENT CARRIER

[76] Inventor: James L. Streit, 709 W. Third St., Wilbarger County, Tex. 79252

[21] Appl. No.: 35,911

[22] Filed: May 4, 1979

[51] Int. Cl.[3] ..... G10G 5/00

[52] U.S. Cl. ..... 84/421; 224/910

[58] Field of Search ..... 84/421, 327; 224/910

[56] References Cited

U.S. PATENT DOCUMENTS

| | | | |
|---|---|---|---|
| 241,195 | 5/1881 | Cubley | 84/421 |
| 1,810,519 | 6/1931 | Gerhart | 84/327 |
| 3,106,123 | 10/1963 | Johaunsen | 84/421 |
| 3,974,732 | 8/1976 | Kester | 84/421 |
| 4,158,980 | 6/1979 | Gauger | 84/421 |

*Primary Examiner*—Lawrence R. Franklin

*Attorney, Agent, or Firm*—Stephen D. Carver

[57] ABSTRACT

A percussion instrument carrier particularly adapted for marching. The instrument carrier comprises a rigid frame having a pair of spaced-apart hook members for contacting the shoulder blades of the marcher, an integral rear support portion adapted to rest upon the back of the marcher, a pair of forwardly-projecting, spaced-apart arm members for securing the percussion instrument in a playing position, and means for coupling the arm members to the supportive frame at a height convenient to the marcher. A releasable belt is coupled at opposite ends thereof between downwardly projecting portions of the frame to aid in securing the carrier to the marcher while facilitating marcher comfort.

6 Claims, 7 Drawing Figures

PERCUSSION INSTRUMENT CARRIER

BACKGROUND OF THE INVENTION

This invention relates to percussion instruments such as drums or the like. More particularly, the present invention relates to a carrier device for holding a percussion instrument which may be comfortably worn by a marcher.

A variety of percussion musical instrument holders or carriers are known in the prior art. Examples of relevant prior art may be seen in U.S. Pat. Nos. 3,974,732, issued Aug. 17, 1976; 3,106,123, issued Oct. 8, 1963; and 3,021,744, issued Feb. 20, 1962. Prior art devices known to applicant typically comprise one or more straps which are buckled over the shoulders of the marcher and which are coupled through various means to the instrument to be played. Usually some form of forwardly projecting structure is provided to maintain the instrument at a predetermined distance in front of the marcher. In U.S. Pat. No. 3,106,123, rearwardly projecting hook means are shown for engagement over the marcher's shoulders.

Comfort of the holding device is of paramount importance to a marcher. Also, particularly when it is necessary to march in tight formations, it is important that the instrument be maintained in a particular playing position notwithstanding vibrations caused by performer movement. Where prior art instrument carrier devices are loosely fitted to the marcher, the instrument may tend to shift in position and become somewhat difficult to play. On the other hand, where the instrument is rigidly maintained at a particular playing position, the straps or structure associated with the carrier can cause painful discomfort to the marcher. It is thus important to provide in an instrument carrier a device which will maintain the playing instrument in a given playing position while at the same time providing an increased measure of player comfort.

SUMMARY OF THE INVENTION

The present invention comprises a percussion instrument carrier adapted to be worn by a marcher for comfortably maintaining the instrument at a substantially constant position during marching.

In a preferred form of this invention the percussion instrument carrier comprises a rigid supporting frame comprising a pair of spaced-apart loops for engaging the shoulder blades of the marcher and a cooperating, integral portion adapted to contact the back of the marcher for suspending the apparatus from the player's torso. A pair of elongated, spaced-apart arm members project forwardly out from the frame for supporting the percussion instrument. Mounting means are provided for coupling the arm members to the apparatus frame in a desired playing position. A releasable belt, coupled between opposite sides of the frame, may be comfortably worn by the user to secure the instrument in place on his person. The belt ends are loosely coupled to the apparatus frame to permit ease of movement thereby facilitating wearer comfort. A tie-down cord associated with the outwardly projecting arm members may be fastened in place as desired by the user to appropriately mount the instrument.

Thus a primary object of this invention is to provide a percussion musical instrument carrier adapted to maintain a percussion instrument such as a drum or the like in a substantially constant playing position.

A similar object of this invention is to provide a percussion musical instrument carrier of the character described which may be easily and quickly assembled and worn.

Still another object of this invention is to provide a musical instrument carrier of the character described of lightweight, flexible characteristics to aid to wearer comfort.

A similar object of this invention is to provide a percussion musical instrument carrier which will function appropriately without the use of characteristically uncomfortable rear straps.

Yet another object of this invention is to provide a musical instrument carrier of the character described which will be substantially stable notwithstanding leg movement of the marcher.

A still further object of this invention is to provide a percussion instrument carrier which may be quickly and easily adjusted in height to suit marchers of varying sizes and shapes.

Yet another object of this invention is to provide a drum carrier of the character described which will substantially maintain the percussion instrument to be played in a level position.

These and other objects and advantages of this invention, along with features of novelty appurtenant thereto, will appear or become apparent in the course of the following detailed description.

BRIEF DESCRIPTION OF THE INVENTION

In the following drawings, which form a part of the specification and which are to be construed in conjunction therewith, and in which like reference numerals have been employed throughout to indicate like parts in the various views.

DETAILED DESCRIPTION OF THE INVENTION

Figure 1:
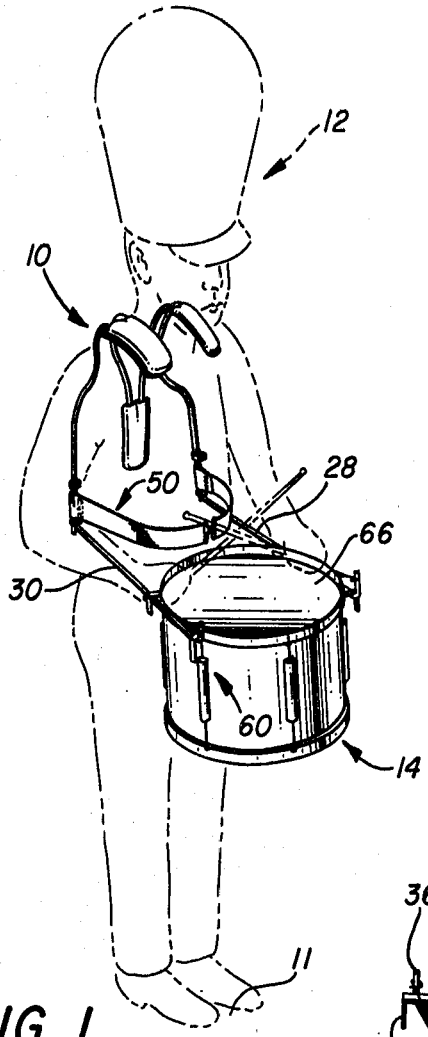
FIG. 1 is a perspective, pictorial view showing the invention in use mounted upon a marcher.
Figure 3:
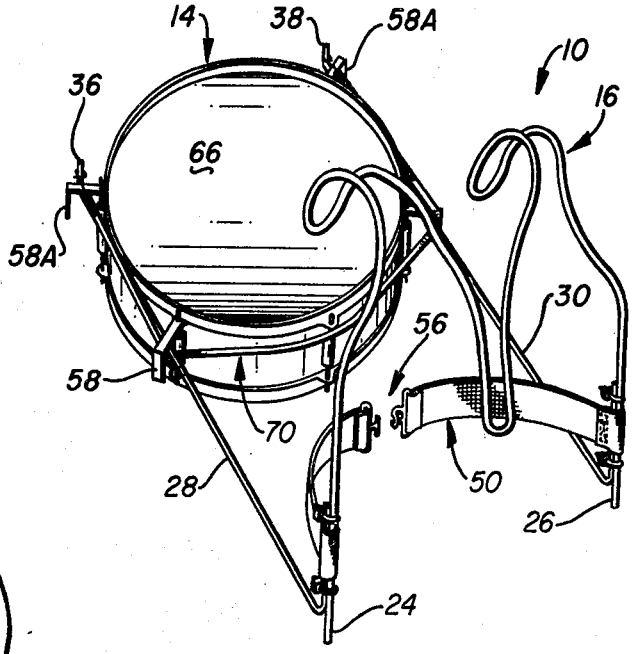
FIG. 3 is a perspective view of the invention.
Figure 2:
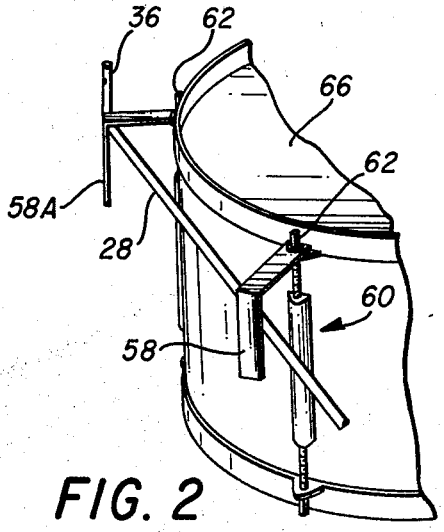
FIG. 2 is an enlarged view showing a percussion instrument to be carried and the mounting clamps preferably attached thereto.
Figure 4:
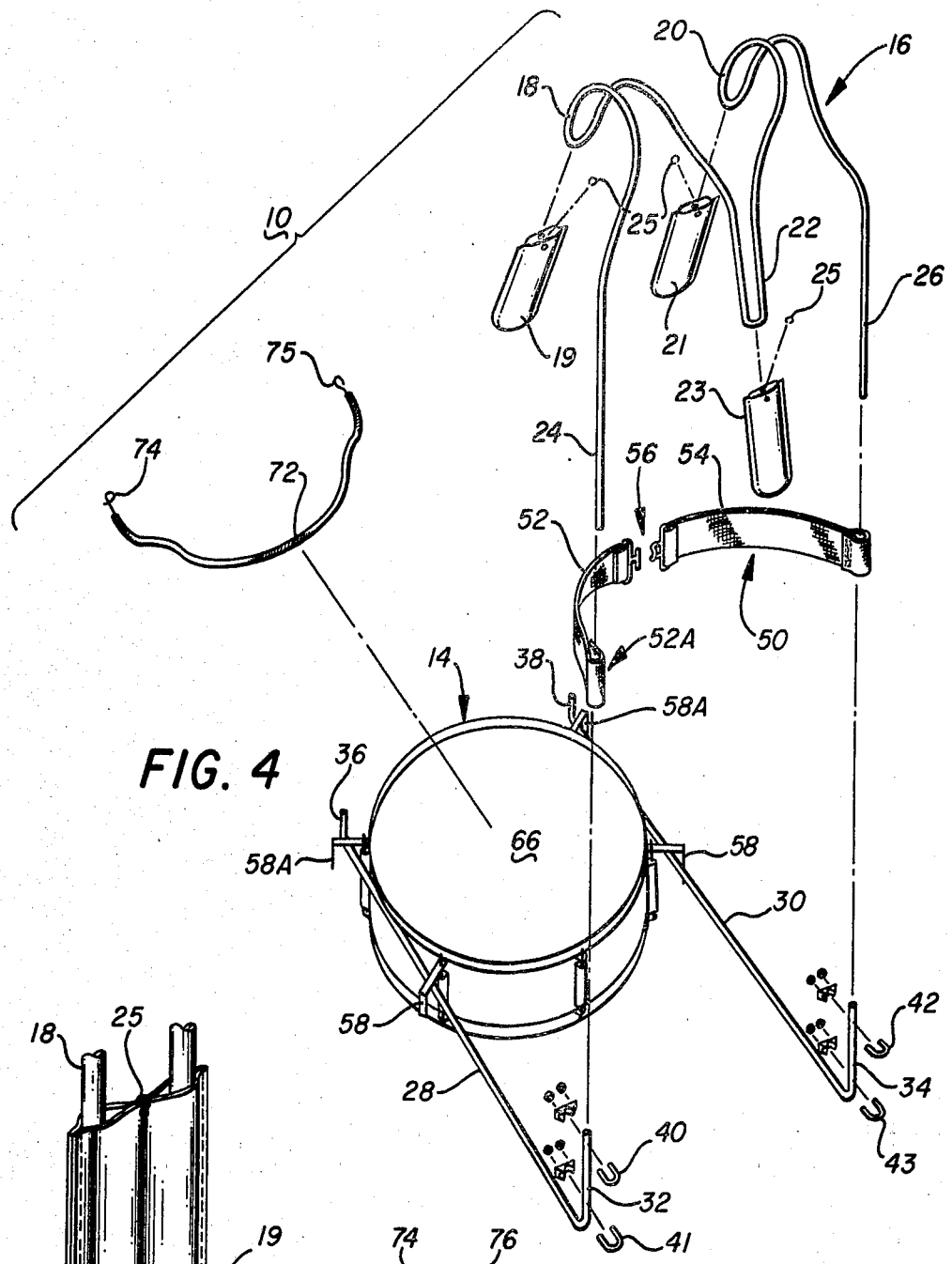
FIG. 4 is an exploded perspective view of the invention.

With initial reference to FIGS. 1, 3 and 4 of the drawings, the invention 10 is adapted to be worn by a performer or marcher 12 (FIG. 1) for carrying a percussion instrument such as a drum 14. As will be appreciated from FIG. 1, the percussion instrument carrier 10 is adapted to be coupled to the upper torso of the marcher 12 so that the drum 14 will be maintained in a predetermined playing position in front of the player 12.

Figure 6:
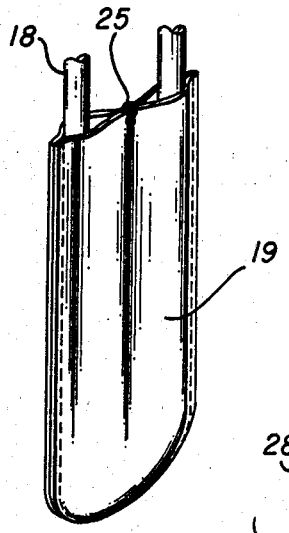
FIG. 6 is an enlarged, perspective view of a frame hook member illustrating the padding employed in conjunction with the frame hook members and the rear support portion.

The instrument carrier 10 comprises a preferably rigid, metallic frame 16 which suspends the carrier 10 from the marcher 12. The frame 16 may be formed from an elongated, perferably metallic rod which is appropriately bent in conventional bending devices to form a pair of spaced-apart, hook members 18 and 20 which are adapted to rest upon the shoulder blades of the marcher 12. Integral with hook portions 18 and 20 is a rear support portion 22 which rests upon the back of performer 12 when the device 10 is worn. Portion 22 forms a substantially 3-point suspension system with hook members 18 and 20. Frame 16 also comprises first and second spaced-apart elongated members 24 and 26 which are integral with hooks 18, 20 and which are adapted to project substantially vertically downwardly (as viewed in FIGS. 1, 4) on opposite sides of the marcher 14. It has been found desirable to construct the frame 16 from a solid, approximately ⅜th inch diameter metal rod approximately 10 feet in length, which may be formed into the illustrated configuration by a conventional bending machine. A plurality of substantially rectangular pads 19, 21 and 23 are provided for padding the hooks 18, 20 and support means 22 respectively. In this manner player comfort is enhanced. The pads may be pulled over the respective frame member 18, for example, (FIG. 6) and permanently fastened in proper position via fasteners 25 or the like.

A pair of elongated, preferably metallic rigid arms 28 and 30 are provided for receiving and supporting the percussion instrument 14. It will be apparent from FIGS. 1 and 4 that the spaced-apart arm members 28 and 30 are adapted to be substantially horizontally oriented, projecting generally perpendicularly outwardly from the frame member 16. Each of the arm members 28, 30 comprise upwardly (as viewed in FIGS. 1, 4) turned inner end portions 32, 34 respectively and upwardly turned outer end portions 36, 38. End portions 36 and 38, as will be described in more detail later, facilitate coupling of the percussion instrument 14 to the carrier device 10. The inner, upwardly turned end portions 32, 34 are adapted to be structurally coupled to the downwardly projecting frame elongated members 24, 26 respectively through a plurality of U-clamps 40 thru 43. As best viewed in FIG. 1A the U-clamps are adapted to rigidly secure the upwardly turned arm end portions to the frame arm elongated members 24, 26 at a desired position relative to the ground 11. By simply loosening and then tightening the various clamp nuts 46, it will be apparent that the arm members 28, 30 may be positioned at desired playing height relative to the carrier frame 16 to support the drum 14 in a desired position.

Figure 1A:
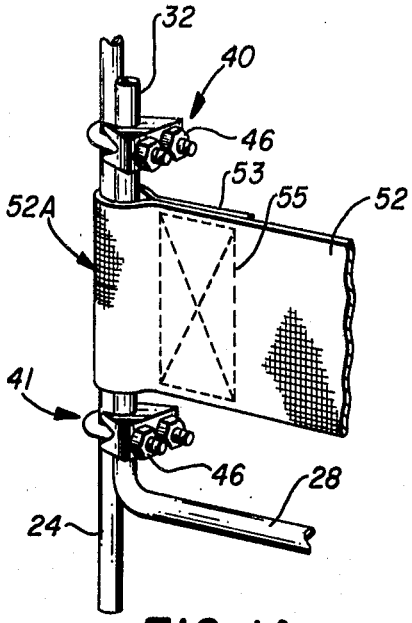
FIG. 1A is an enlarged, perspective view showing how the releasable belt is rotatably coupled to the carrier frame, with parts thereof broken away for clarity.

A belt 50 is provided for further securing the carrier to the player 12. Belt 50 comprises opposite segments 52 and 54 which are adapted to be coupled together through a conventional buckle 56. The belt segments 52, 54 are substantially loosely or rotatably coupled to the frame member 16 thereby facilitating wearer comfort. For example, as best illustrated in FIG. 1A, the end portion of belt segment 52 has been looped about the frame member 24 and the adjacent, upwardly-turned arm end portion 32 between the U-clamps 40, 41. The end flap portion 53 has been stitched tightly to the belt body through stitches 55, thereby forming a coupling whereby the belt portion 52 may move radially with respect to the frame 16. In this manner wearer comfort has been facilitated.

Figure 5:
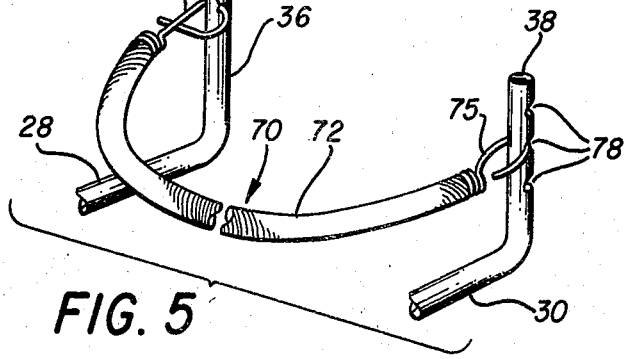
FIG. 5 is an enlarged, perspective view showing the carrier tie-down cord preferably employed by the invention, with parts thereof broken away for clarity.

To attach the drum or other percussion instrument 14 in place upon the carrier device 10, a plurality of L-clamps 58 are provided for mechanical coupling to the conventional tension rod structures 60 via bolts 62 near the upper playing head 66. The instrument 14 may then be "hooked" in place at the outermost end of the arms 28, 30 so that outermost L-clamps 58A abut the upwardly turned outer arm end portions 36, 38. As best illustrated in FIG. 3, a flexible, elastic tie-down cord 70 is provided for securing the percussion instrument 14 in place between carrier arms 28, 30. The body portion 72 of the tie-down cord terminates in a pair of preferably metallic hooks 74, 75 (FIG. 5). Tie-down hook 74 is adapted to be permanently secured to the outermost upwardly turned arm end portion 36 through a hole 76 provided therein. Tie-down cord hook portion 75 is adapted to be selectively coupled to one of a plurality of notches 78 provided within outermost arm end portion 38, which facilitates quick adjustment of the instrument 14. As best viewed in FIG. 3, the tie-down cord 70 is preferably stretched substantially throughout the periphery of the instrument 14 and looped over one or more L-shaped clamps 58 to properly secure the drum 14.

Thus, when a performer 12 prepares to utilize the carrier 10, the player may first attach L-clamps 58 at opposite corners of the instrument 14 in a conventional fashion. Afterwards, the instrument 14 may be dropped into place between the arms 28, 30 and secured thereto by placement of the tie-down cord 70 as illustrated in FIG. 3. Once the U-clamp members 40 through 43 are adjusted so that arms 28, 30 suspend the drum in a desired vertical playing height, the belt 50 may be secured by fastening buckle 56. The instrument 14 may then be utilized with a maximum of playing comfort by marcher 12.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A percussion instrument carrier comprising:

rigid supportive frame means for suspending said carrier from a marcher, said frame means comprising:

a pair of spaced-apart hook members for resting upon shoulder blades of said marcher;

rear support means integral with said hook members adapted to rest upon the back of said marcher; and first and second spaced-apart, substantially parallel elongated members integral with said hook members and said rear support means;

a pair of elongated, spaced-apart arm members adapted to secure said percussion instrument in a playing position; and means for coupling said arm members to said supportive frame.

2. The combination as defined in claim 1 wherein said carrier comprises belt means extending between said elongated frame members for bracing said carrier to said marcher.

3. The combination as defined in claim 2 wherein opposite ends of said belt means are rotatably coupled between parallel frame members for facilitating marcher comfort.

4. The combination as defined in claim 1 wherein said spaced-apart arm members each terminate in upwardly-turned end portions, and said carrier comprises means for clamping said arm end portions to said frame elongated members whereby said percussion instrument may be selectively rigidly positioned at a desired playing height.

5. The combination as defined in claim 4 wherein said carrier comprises belt means for bracing said carrier to said performer, said belt means having first and second end portions rotatably coupled to said frame elongated members thereby facilitating marcher comfort.

6. The combination as defined in claim 4 wherein said carrier comprises a plurality of clamps for suspending said percussion instrument from said carrier in a desired position between said spaced-apart arm members; and tie-down means adpated to be releasably coupled to said arm members for bracing said percussion instrument therebetween.

* * * * *